US005993306A

United States Patent [19]

McCoy et al.

[11] Patent Number: 5,993,306

[45] Date of Patent: Nov. 30, 1999

[54] SANDING AND CLEANING DEVICE FOR DRYWALL BULLNOSE CORNERBEADS

[75] Inventors: Charles D. McCoy, Sarasota; James E. McCoy, Venice, both of Fla.

[73] Assignee: Pro-Line, Inc., Sarasota, Fla.

[21] Appl. No.: 09/034,423

[22] Filed: Mar. 4, 1998

[51] Int. Cl.[6] ..... C07C 2/02

[52] U.S. Cl. ..... 451/523; 451/524

[58] Field of Search ..... 451/523, 524, 451/525

[56] References Cited

U.S. PATENT DOCUMENTS

| | | | |
|---|---|---|---|
| 3,648,418 | 3/1972 | Churchich | 51/392 |
| 3,878,581 | 4/1975 | Perna . | |
| 4,230,441 | 10/1980 | Heronema . | |
| 4,330,964 | 5/1982 | Martinez | 51/170 MT |
| 4,619,013 | 10/1986 | Yon . | |
| 4,823,515 | 4/1989 | Blome | 51/363 |
| 4,878,317 | 11/1989 | Ovens | 51/170 TL |
| 4,907,955 | 3/1990 | Snipes . | |
| 4,946,360 | 8/1990 | Brown . | |
| 5,069,610 | 12/1991 | Milburn . | |
| 5,131,193 | 7/1992 | Demers | 51/391 |
| 5,203,885 | 4/1993 | Pastre et al. | 51/298 |
| 5,368,461 | 11/1994 | Murphy . | |
| 5,392,484 | 2/1995 | Stolzfus . | |
| 5,544,384 | 8/1996 | Forselius et al. . | |
| 5,545,287 | 8/1996 | Carlson . | |
| 5,638,570 | 6/1997 | Gruner . | |
| 5,759,090 | 6/1998 | Kawate et al. | 451/56 |

*Primary Examiner*—Joseph J. Hail, III
*Assistant Examiner*—Dermott J. Cooke
*Attorney, Agent, or Firm*—Charles J. Prescott

[57] ABSTRACT

A device for abrading and finishing excess cured filler material from a bullnose outside cornerbead connected between immediately adjacent sheets of drywall. The device includes an elongated rigid body having a generally concave-shaped central longitudinal portion which preferably replaceably receives a sheet of somewhat compressible open fibrous adhesive material which is preferably substantially coextensive with, and arcuately formed to match the bullnose cornerbead convex contour, by the central longitudinal portion. In the preferred embodiment, a guide rail extends along either longitudinal margin of the central longitudinal portion which, in cooperation with the abrasive layer mateingly engaged against the bullnose cornerbead, substantially match the outside angle between the adjacent drywall sheets.

2 Claims, 3 Drawing Sheets

FIG. 6
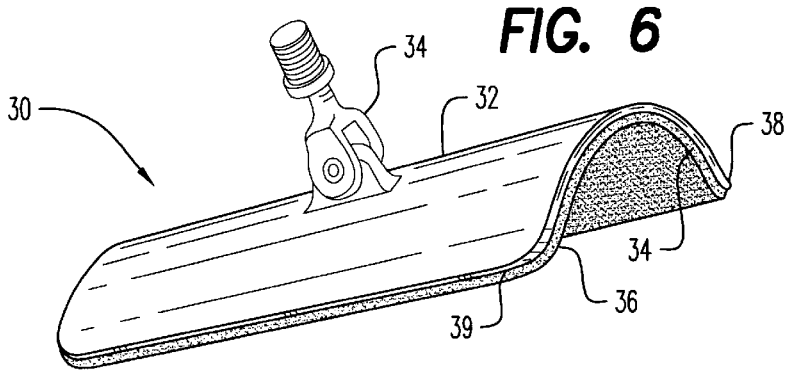
FIG. 7
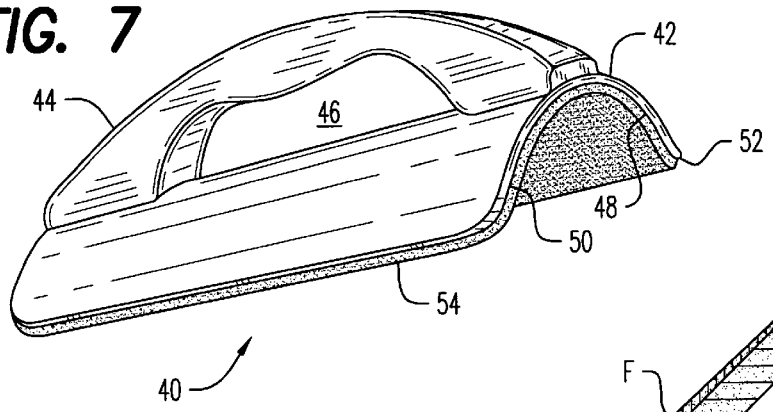
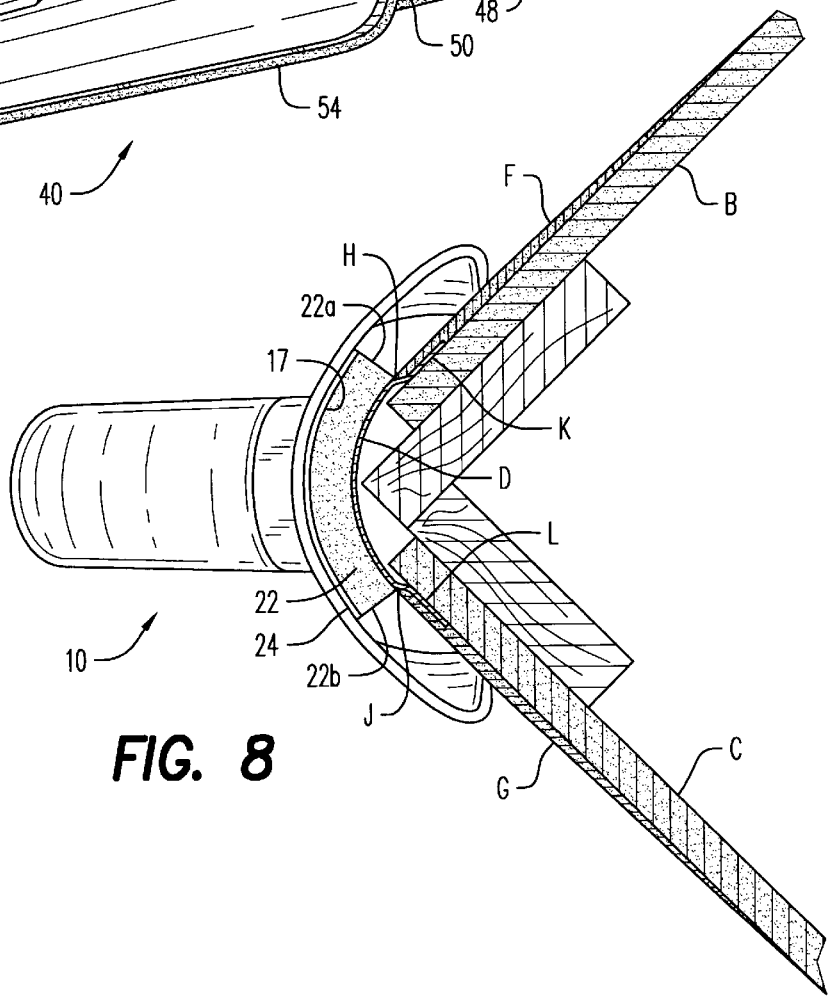
FIG. 8

SANDING AND CLEANING DEVICE FOR DRYWALL BULLNOSE CORNERBEADS

BACKGROUND OF THE INVENTION

1. Scope of Invention

This invention relates generally to devices for sanding and finishing drywall installations, and more particularly to a device for cleaning and finishing outside bullnose joints between adjacent sheets of drywall.

2. Prior Art

There are a number of prior art devices used for finishing drywall installation corners and surfaces. Some of these devices known to applicants are directed to the application of cementious drywall filler compound, the majority of these devices however are directed to the sanding, scraping or finishing of the cured drywall compound prior to painting or wallpapering the finished drywall surfaces.

The following U.S. patents are known to applicant which generally fit into this category of prior art devices:

| | |
|---|---|
| U.S. Pat. No. 5,544,384 | Forselius, et al. |
| U.S. Pat. No. 3,878,581 | Perna |
| U.S. Pat. No. 5,545,287 | Carlson |
| U.S. Pat. No. 4,907,955 | Snipes |
| U.S. Pat. No. 4,948,360 | Brown |
| U.S. Pat. No. 5,069,610 | Milburn |
| U.S. Pat. No. 4,619,013 | Yon |
| U.S. Pat. No. 4,230,441 | Heronema |
| U.S. Pat. No. 5,368,461 | Murphy |

All of these above prior art devices are either adapted to fill or finish flat drywall surfaces or inside or outside drywall joint areas which have sharp or crisp inside or outside corners.

A recently introduced feature for drywall outside corner joints is typically referred to as a "bullnose" cornerbead or joint. Those outside cornerbeads are formed of elongated metal strips which define an arcuate or radiused quarter circle cylindrical surface when attached to the adjacent edges of drywall panels. Applicants are not yet aware of an effective means for cleaning and sanding excess drywall filler compound from these bullnose corners without significantly abrading the immediately adjacent cured drywall filler compound.

However, the invention disclosed in U.S. Pat. No. 5,638,570 invented by Gruner teaches a drywall bullnose cleaner tool which scrapes excess filler compound from the radiused surfaces of an outside bullnose corner joint of such a drywall installation. However, scraping action may not be best suited for optimal smooth finishing of the bullnose corner. Another device for the scraping, cleaning and finishing of bullnose joints is disclosed by Stoltzfus in U.S. Pat. No. 5,392,484. Again, the scraping of the cylindrical bullnose surface is not fully effective in producing a smooth, high quality finished surface ready for painting.

The present invention teaches a cleaning and finishing device for bullnose cornerbeads or joints which more gently and uniformly abrades away excess cured or hardened drywall filler compound without concern for overly abrading and grooving the drywall filler compound immediately adjacent the edge of the metal bullnose joint. Further, by including a somewhat resilient or compliant abrasive fibrous pad which accomplishes the cleaning and finishing action, any non-uniformity of the bullnose joint is easily accommodated.

BRIEF SUMMARY OF THE INVENTION

This invention is directed to a device for abrading and finishing excess cured filler material from a bullnose cornerbead which forms an outside corner joint between immediately adjacent sheets of drywall. The device includes an elongated rigid body having a generally concave-shaped central longitudinal portion which preferably replaceably receives a sheet of somewhat compressible non-woven open fibrous adhesive material which is preferably substantially coextensive with, and arcuately formed to match the bullnose joint contour, by the central longitudinal portion. In the preferred embodiment, a guide rail extends along either longitudinal margin of the central longitudinal portion which, in cooperation with the contoured abrasive layer mateingly engaged against the bullnose corner, substantially match the outside corner angle between the adjacent drywall sheets.

It is therefore an object of this invention to provide an improved sanding and cleaning device for removing and finishing bullnose cornerbead joints of drywall installations.

It is another object of this invention to provide a device for sanding and cleaning excess drywall filler or fairing compound from metal strips which form radiused bullnose joints between adjacent drywall panels.

It is yet another object of this invention to provide a device for sanding and cleaning bullnose joints of drywall installations which readily accommodates any irregularity in the metallic strip forming these bullnose joints.

It is still another object of this invention to provide a device for sanding and cleaning excess drywall filler compounds from bullnose corner joint which includes a replaceable fibrous abrasive pad or layer.

In accordance with these and other objects which will become apparent hereinafter, the instant invention will now be described with reference to the accompanying drawings.

BRIEF DESCRIPTION OF THE DRAWINGS

FIG. 6 is a perspective view of another embodiment of the invention.

FIG. 7 is a perspective view of still another embodiment of the invention.

FIG. 8 is an enlarged view similar to FIG. 3 showing the typical bullnose corner joint in section.

DETAILED DESCRIPTION OF THE INVENTION

Figure 1:
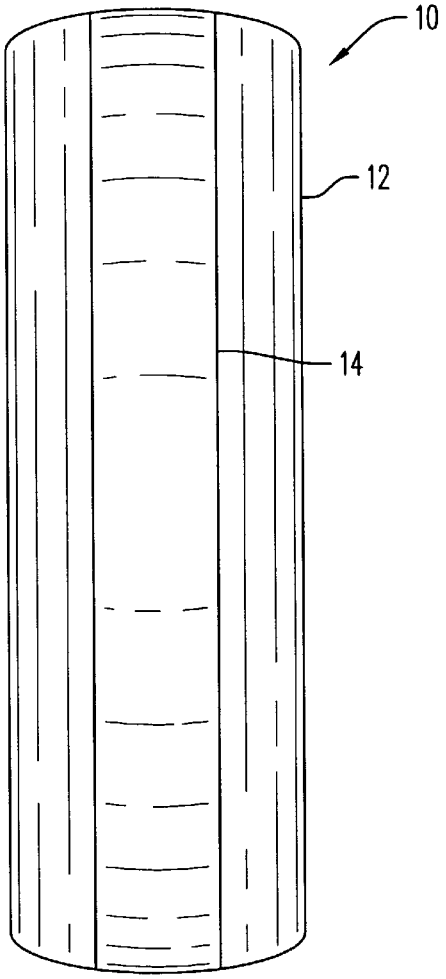
FIG. 1 is a back plan view of the preferred embodiment of the invention.
Figure 2:
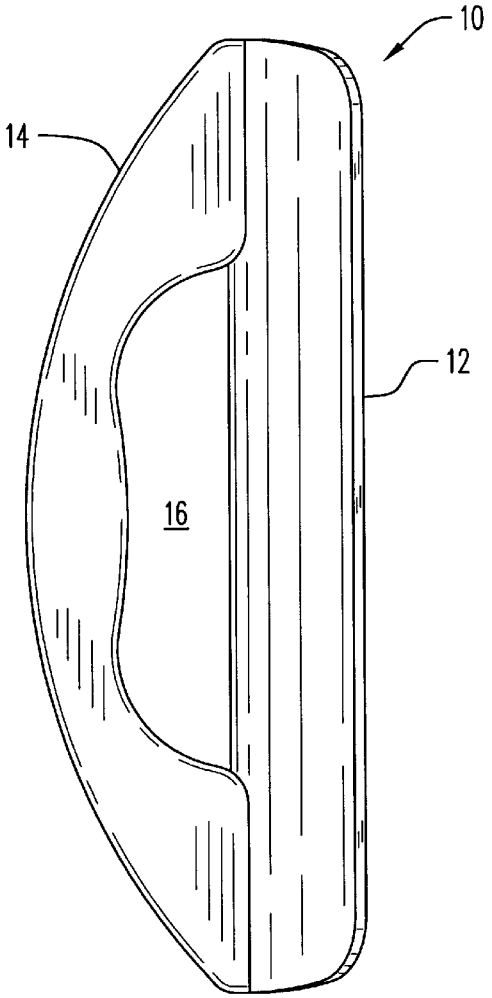
FIG. 2 is a side elevation view of FIG. 1.

Referring now to the drawings, and particularly to FIGS. 1 to 5, the preferred embodiment of the invention is shown generally at numeral 10. This sanding and abrading device 10 includes an elongated molded plastic rigid body 12 having a handle 14 attached to the convex or back surface thereof which defines a hand holding opening 16 for grasping by a user.

Figure 3:
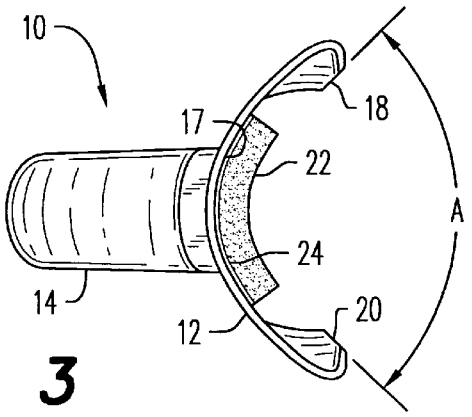
FIG. 3 is an end elevation view of FIG. 2.
Figure 4:
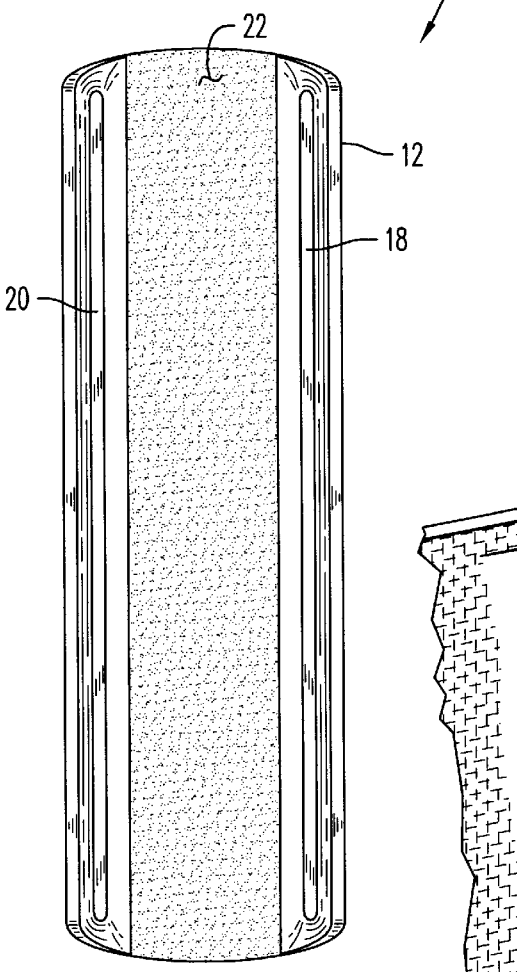
FIG. 4 is a front plan view of FIG. 1.

As best seen in FIGS. 3 and 4, the inner or front surface 17 of the molded body 12 is generally concaved and somewhat circular and cylindrical in nature. A layer 22 of open non-woven fibrous abrasive material such as that known as SCOTCH-BRITE by 3M Company is replaceably attachable by an adhesive layer 24 longitudinally coextensive with the central portion of the concave surface 17. Spaced, parallel longitudinally extending guide runners or rails 18 and 20 generally define the longitudinal side margins of the body 12 and define an angle A as seen in FIG. 3 which is substantially equal to the outside angular dimension between adjacent drywall sheets B and C as shown in FIG. 8. Although typically drywall corners are orthogonal, the invention is easily adapted to a broad range of outside angles as called for by architectural design.

Figure 5:
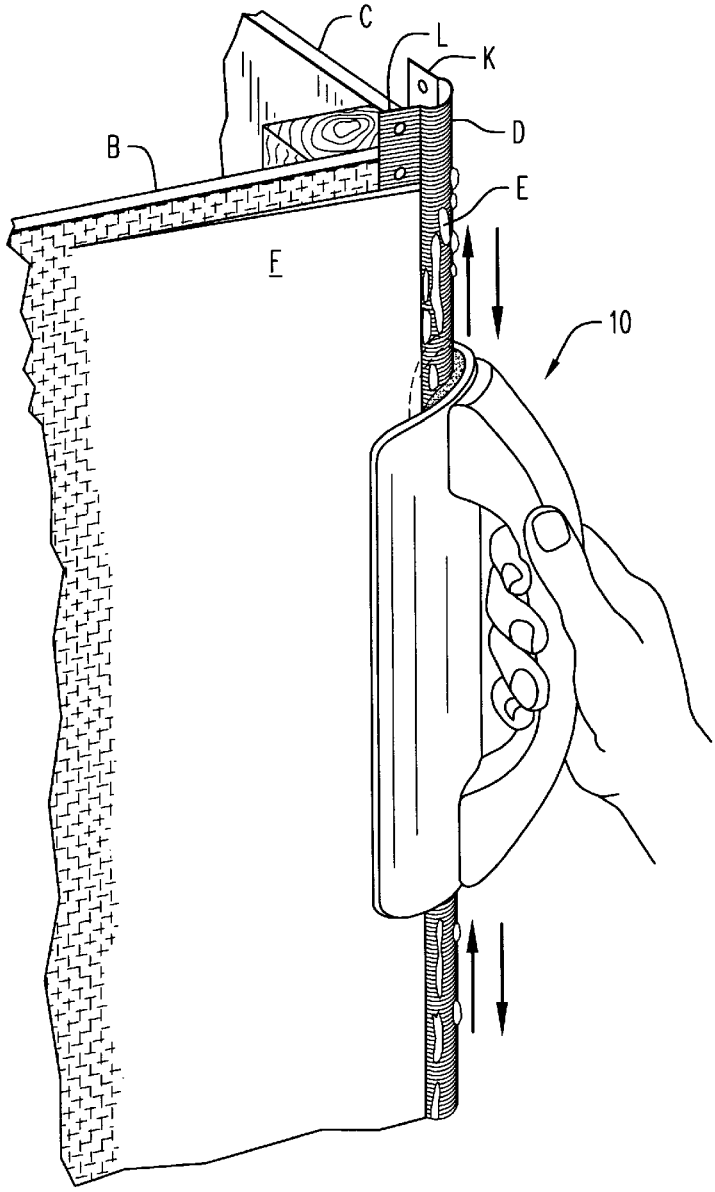
FIG. 5 is a perspective view of the invention shown in FIG. 1 in use in the removal of excess drywall filling compound from a typical bullnose corner joint.

These runner surfaces 18 and 20, in combination with the concave surface of the abrasive layer 22 which is also generally rounded and cylindrical in nature, mateably engage against an elongated metal bullnose cornerbead D shown in FIGS. 5 and 8. This bullnose cornerbead D is attached by its longitudinal edge margins K and L to the supporting drywall sheets B and C as by nailing therethrough. Thus, the rounded cylindrical outer surface of the bullnose cornerbead D will ultimately be finish sanded and exposed for painting. A layer of cementious-type drywall filler compound is applied along F and G so as to fair or feather in the longitudinal edges H and J of exposed rounded central portion of the bullnose cornerbead D. When the cementious material is applied, typically the radiused or contoured rounded portions of the bullnose cornerbead D are also inadvertently covered with this cementious filler material. When cured, it must be removed and smoothly finished to receive paint or other coating materials thereafter. Note that the invention 10 is preferably not intended to substantially finish these faired filler portions F and G as that is left to other drywall sanding implements of a generally flat nature.

As best seen in FIG. 5, the device 10 in use is pressed against the bullnose cornerbead D and then moved longitudinally thereof in the direction of the arrows along the length of the bullnose joint D to abrasively remove cured excess filler material E and to finish sand the exposed radiused portions of each bullnose corner. Again, the runner or rail guides 18 and 20, in cooperation with the inner concave contour of the abrasive pad 22, substantially match or mate with the transverse cross section of the bullnose joint and adjacent drywall panels as best shown in FIGS. 5 and 8.

Although preferably made replaceable, the non-woven fibrous abrasive material may also be permanently adhered into the position shown in FIGS. 3, 4 and 8 and then easily cleaned by either impact or by being soaked and rinsed in warm water.

Referring now to FIGS. 6 and 7, two alternate embodiments of the invention are there shown generally at numerals 30 and 40, respectively. The embodiment 30 is adaptable by a threaded pivotal joint 34 to be threadably connected to an elongated sanding pole for bullnose joints which are not accessible from the floor surface. This embodiment 30 also includes a molded plastic body defining a concaved surface 34 adapted to receive a pad of fibrous abrasive material 36 as previously described. The abrasive pad 36 extends between the somewhat straight edge margins 38 and 39 of the molded body 32 so as to extend, when in use, somewhat beyond the exposed edges H and J in FIG. 8 of the bullnose cornerbead D and to at least partially sand and fair these edges of the filler material F and G which is immediately adjacent to the exposed rounded surface of the bullnose cornerbead D at H and J.

Likewise, the embodiment 40 in FIG. 7 also includes a similarly shaped body 42 to which handle 44 is attached and extends therefrom to provide hand-grasping opening 46. The concave surface 48 has attached thereto the abrasive fibrous pad 50 which extends to side margins 52 and 54 of the molded body 42. These alternate embodiments 30 and 40 are intended to be within the scope of this invention although they are not preferred because the guide rails of the embodiment 10 previously described serve to better avoid any grooving of the cured filler material immediately adjacent to the rounded edges H and J of the bullnose joint D due to excessive pressure or repetitive sanding action, the filler material in F and G being substantially softer and easier to abrade and wear away than the steel material of the bullnose cornerbead D.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A bullnose cornerbead sanding and cleaning device for removing cured drywall filler compound from, and finish sanding a bullnose cornerbead which forms a lengthwise extending raised-rounded corner joint between adjacent drywall sheets of a drywall installation comprising:

an elongated body having a concave-shaped central longitudinal portion positioned between two spaced straight, parallel guide runners disposed along longitudinal margins of said elongated body, a handle means extending away from said elongated body;

a compressible abrasive layer releasably attached and contoured to said central longitudinal portion for mateable sanding and cleaning engagement against only the bullnose cornerbead and drywall filler compound thereon;

said guide runner, in cooperation with said abrasive layer, substantially mating against adjacent drywall panels and the bullnose cornerbead, respectively whereby substantially only the bullnose cornerbead and drywall filler compound thereon comes into sanding contact with said abrasive layer.

2. A sanding and cleaning device as set forth in claim 1, further comprising: means for replacing said abrasive layer.

* * * * *